United States Patent [19]

Rosberg et al.

[11] 4,359,786

[45] Nov. 23, 1982

[54] ACCESSORY FOR USE IN SUPPORTING A URINAL MEMBER AT A PATIENT'S BEDSIDE IN HOSPITALS AND THE LIKE

[76] Inventors: Carl H. Rosberg; Hazel R. Rosberg, both of 127 Airport Rd., Hyannis, Mass. 02601

[21] Appl. No.: 184,774

[22] Filed: Sep. 8, 1980

[51] Int. Cl.[3] ..... A47K 1/08; A45D 19/04

[52] U.S. Cl. ..... 4/144.1; 248/146; 248/154; 248/311.2; 248/DIG. 10

[58] Field of Search ..... 248/146, DIG. 10, 159, 248/311.2, 310, 154, 159, 176, 178; 4/144.1

[56] References Cited

U.S. PATENT DOCUMENTS

| | | | |
|---|---|---|---|
| 905,627 | 12/1908 | Astruck | 248/146 |
| 1,043,387 | 11/1912 | Astruck | 248/159 |
| 1,270,004 | 6/1918 | Chappell | 248/DIG. 10 |
| 1,351,817 | 9/1920 | Walters | 248/176 |
| 1,396,445 | 11/1921 | Loudon | 248/154 |
| 1,406,893 | 2/1922 | Randall | 248/146 |
| 1,545,203 | 7/1925 | Schaefer, Jr. | 248/146 |
| 1,742,069 | 12/1929 | Greenwald et al. | 248/310 |
| 1,851,560 | 3/1932 | Aronson | 248/154 |
| 1,936,664 | 11/1933 | Fransosi | 248/154 |
| 2,448,413 | 8/1948 | Borghesi | 248/DIG. 10 |
| 2,529,780 | 11/1950 | Miller | 248/159 |
| 2,576,832 | 11/1951 | Gibson | 248/146 |
| 2,861,764 | 11/1958 | Fisher | 248/146 |
| 3,123,257 | 3/1964 | Miller | 248/311.2 |
| 3,169,742 | 2/1965 | Smith | 248/146 |
| 3,178,061 | 4/1965 | Giacalone et al. | 248/311.2 |
| 3,207,462 | 9/1965 | Zimmerman | 248/159 |
| 3,473,772 | 10/1969 | Nilson | 248/311.2 |
| 4,223,859 | 9/1980 | Erickson | 248/154 |

FOREIGN PATENT DOCUMENTS

| | | | |
|---|---|---|---|
| 176572 | 10/1906 | Fed. Rep. of Germany | 248/154 |

*Primary Examiner*—Victor N. Sakran

*Attorney, Agent, or Firm*—Hamilton, Brook, Smith and Reynolds

[57] ABSTRACT

A urinal stand construction includes a relatively heavy pedestal base, a tubular body secured to the base and a urinal holder supported at the upper end of the tubular body releasably holding a urinal member at the bedside of a patient. The urinal holder consists in a thin, circular retaining plate having vertically disposed resilient clip portions occurring in spaced relation around the outer edge of the retaining plate. At its central portion the plate is formed with a conically shaped hollow fitting engageable in an upper end of the tubular body. The parts noted are detachably secured together by an elongated bolt member and hexaginal nuts occurring in recessed relationship in the conically shaped fitting in the bottom of the pedestal base.

3 Claims, 4 Drawing Figures

ACCESSORY FOR USE IN SUPPORTING A URINAL MEMBER AT A PATIENT'S BEDSIDE IN HOSPITALS AND THE LIKE

BACKGROUND OF THE INVENTION

At the present time it is customary in most hospitals for hospital attendants to place beside a hospital bed a table or pedestal tray which is located in a position to extend upwardly above a patient's bed to facilitate serving of food, beverages, medication etc. When the use of a urinal is required by the bed patient, the table or tray is also made use of to support the urinal, as well as to contain drinking water or other beverages. Such as arrangement of the exposed urinal is unsightly from the standpoint of both patient and others around him and may be inconvenient in use and cover other difficulties.

In the art it is well known to employ stands for supporting various articles such as candles, lights, ash trays and the like. Examples of patents of this general nature are U.S. Pat. Nos. 827,199, 1,169,268, 1,406,893, 1,551,637, 1,721,299, 1,877,098, 2,448,413 and 3,415,475.

However, none of these patents suggest a stand construction for use in releasably holding a urinal member in a position to be conveniently utilized by a bed patient in a hospital. Therefore, it is believed that there exists a need for a more efficient and satisfactory means of supporting and storing a urinal member.

SUMMARY OF THE INVENTION

The present invention is concerned with an improved stand construction and in particular a hospital accessory for use in supporting a urinal member at the bedside of a patient in a more suitable way than is presently achieved.

It is a chief object of the invention, therefore, to provide an improved stand construction for supporting a urinal at the bedside of a patient who may be required to remain in bed during a period of convalescence.

Another object is to devise a stand for receiving and supporting a urinal member in a position conveniently accessible to the patient.

Another object is to provide an arrangement of parts by which the urinal is not arranged in an unsightly position and is located in separated relationship to beverage containers and other articles.

Still another object is to construct a urinal stand made up of several conveniently formed parts which may be readily attached to one another when in use but may be also detached from one another for storing and other purposes.

DETAILED DESCRIPTION OF THE INVENTION

Figure 1:
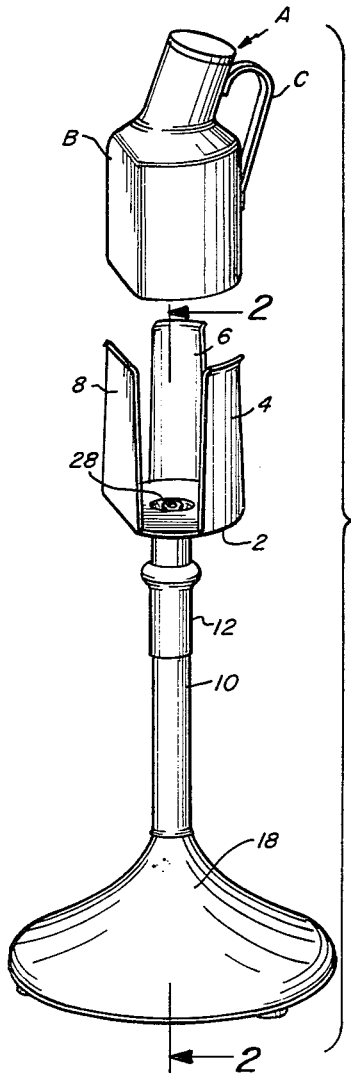

Referring in more detail to the drawings, there is illustrated in FIG. 1 a typical urinal member A as used in hospitals characterized by a container body which at one side is formed with a flattened wall portion B and at an opposite side with a handle C.

At its upper end the container body presents a tubular fluid guide part which extends angularly and rearwardly away from the flattened wall portion B. It is pointed out that this particular design of urinal which is commonly in use in hospitals and nursing homes is designed for use by a patient lying in a hospital bed, either in a prone position or otherwise, and who may be partly incapacitated or ill for other reasons. By means of the flattened wall portion a patient may conveniently locate the urinal on a surface of a bed in a position to resist accidental displacement. It should also be understood that the annularly disposed fluid guide part is oriented with respect to the flattened wall portion in a manner such as to enable a patient to use the urinal and return it to a supporting surface with the fluid guide part maintained in a properly located upright position. Where the patient may require the use of the urinal during periods when the hospital room may be in darkness the design of parts noted is especially helpful to the patient.

The invention apparatus is designed to support the urinal member A in an upright raised position at the bedside of a hospital patient or other ill person confined to a bed. It is further intended that the urinal be positioned such that the handle C is in a conveniently accessible location and the urinal is releasably contained in a holder member as suggested in FIGS. 1 and 2. Numeral 2 denotes a relatively thin retaining part on which the bottom of the urinal member A may be received and located around the outer edge of retaining part 2 are spaced clips as 4, 6 and 8 which may be of a resilient nature suitable for outward flexing when the urinal A is inserted between the clips.

The clips 4 and 6 are arranged to occur at either side of the handle C, as shown in the drawings, and may be formed of an accurate cross-section which substantially conforms to the outer curved surface of the urinal at opposite sides of the handle C. Clip 8, however, is arranged in a position to engage with the flattened wall portion B of urinal A and preferably may be of a cross-section which mates with the shape of the flattened wall section. By means of this arrangement the urinal may be conveniently engaged in the urinal holder by a patient in a prone position with the fluid guide part being maintained in a properly oriented upright position and this correctly oriented upright position may be maintained when the urinal is not in use.

It is contemplated that in one desirable embodiment the holder body may be formed of a metal or plastic material with the clip portions being integral with the part 2. In another desirable form the clips may be separately formed and attached to the part 2.

In accordance with the invention the holder part 2 is supported in a raised position on a separately attached tubular column member in which is provided with an outer sleeve or handle part 12. At its uppermost end the column member 10 is shaped with a conical portion 10A and retaining part 2 is constructed centrally thereof with a conical seat in which the portion 10A is snugly fitted.

Figure 2:
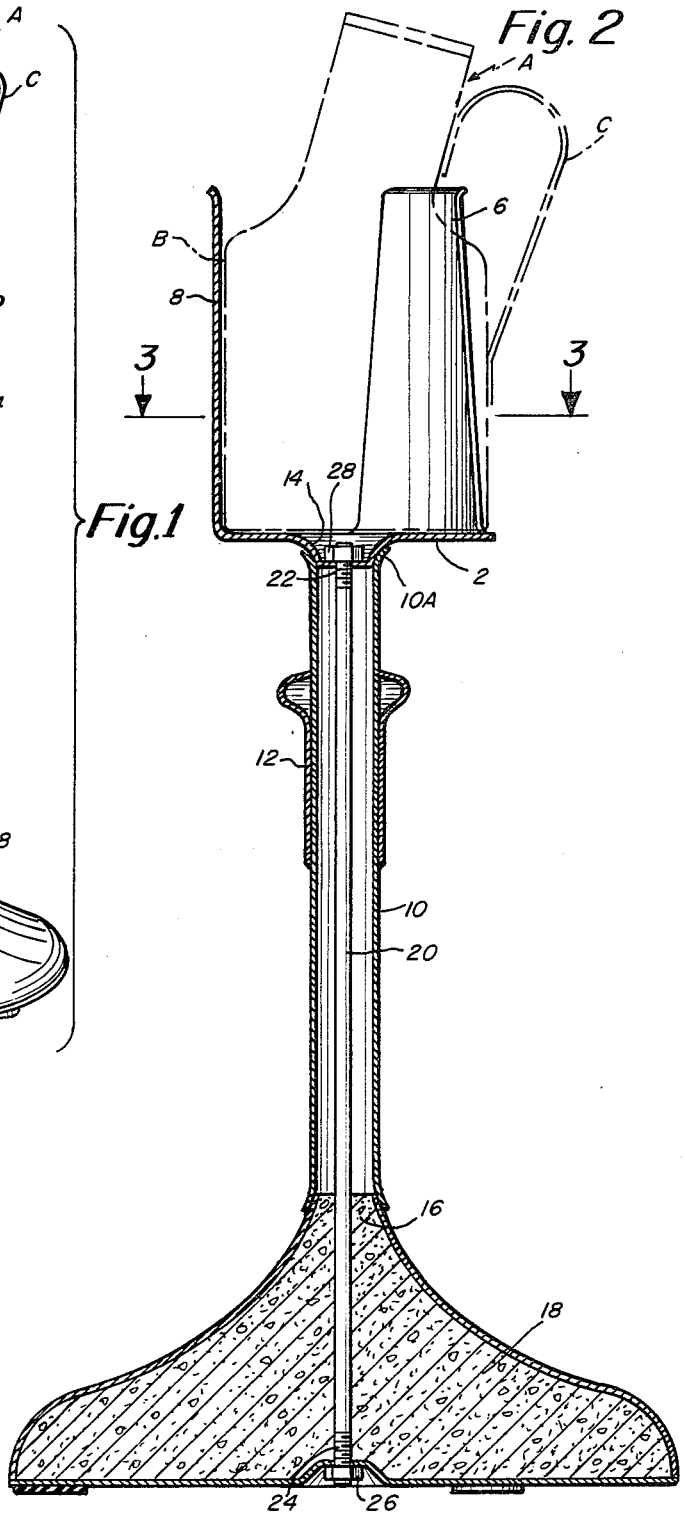
Figure 3:
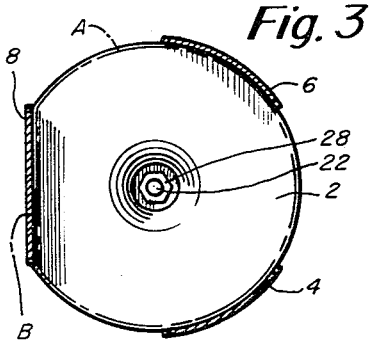
Figure 4:
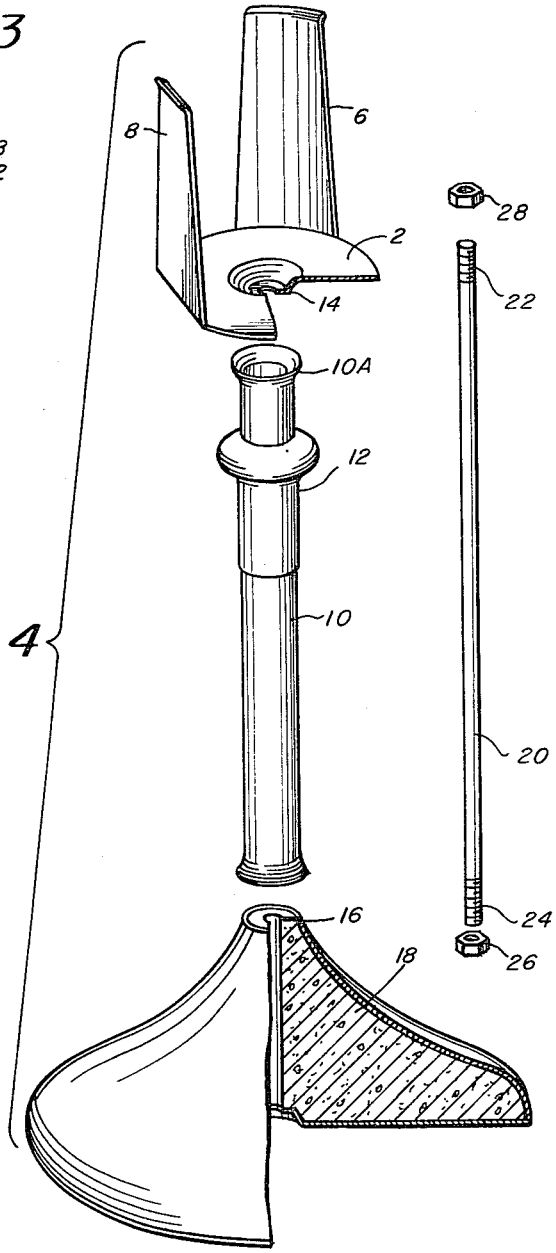

At its lower extremity the column member 10 is expanded to form a conically shaped part as shown in FIG. 2. The conically shaped part is fitted on over a complimentary conically shaped portion 16 of a pedestal base member 18. Formed centrally of the base 18 is an opening 18A through which extends a fastening member 20. The fastening member may, for example, be a bolt member having upper and lower threaded ends 22 and 24. The bottom of base 18 is recessed at its central portion to provide an opening in which may be received a hexagonal nut as 26. The upper threaded end of the fastening 20, as shown in FIG. 2, may have received thereon a second hexagonal nut 28 which is located in recessed relationship in the conical seat 14.

It will be understood that the pedestal member 18 may have enclosed therein a mass M of metal concrete or other relatively heavy substance which will provide a desirable degree of stability for the urinal stand. Preferably there may be attached to the underside of the pedestal spaced apart friction pads as of rubber, plastic or other desired material. In some instances it may be desired to form the pads in the shape of suction cups to further increase the stability of the urinal apparatus.

It may also be desired to form the tubular member 10 in two telescoping sections with suitable detent meant by which the sections may be moved into and out of extended positions to vary the height at which the holder body may be located and other forms of supporting means may be utilized for locating the retaining part 2 and its clips in a raised position.

As may be seen, the parts are readily detached from one another when it is desired to store the components. This is accomplished by simply removing the nuts 26 and 28 and then separating the components from one another.

We claim:

1. A urinal stand construction for use in supporting a urinal member of the class commonly employed in hospitals, characterized by a substantially cylindrical container body having a flattened front wall portion and an opposite rear wall side portion formed with a handle, an upper end of the container body presenting a tubular fluid guide part which extends angularly and rearwardly away from the flattened wall portion, said urinal stand construction including a urinal holder and means for supporting the urinal holder in a raised position at a bedside, said urinal holder comprising a flat retaining part on which the bottom of the said urinal member may be received, vertically disposed resilient clip portions located around outer edges of the flat retaining part in spaced apart relationship, two of said clip portions being arranged to engage the urinal container body at opposite sides of the urinal handle, a third clip portion arranged to engage against the said flattened side wall of the urinal container body, said third clip portion being formed with a flat surface and said surface being of a shape which mates with the flattened wall portion to guide the urinal into the urinal holder into a position in which the tubular fluid guide part is maintained in properly oriented relationship and releasably secured in an upright position, wherein said means for supporting the urinal holder includes a tubular body, a pedestal base and a fastening element detachably securing these parts together, said urinal holder characterized by a flat retaining part in which is formed a conical seat for receiving a nut element located in threaded relationship with a fastening element.

2. The invention of claim 1 in which the means for supporting the urinal holder includes a relatively heavy pedestal base and a tubular column extending upwardly therefrom with a hand grip part located at the upper end of the tubular column.

3. The invention of claim 2 in which a fastening element is located through the tubular column, a threaded lower extremity of the fastening being secured in a centrally disposed recessed portion of the pedestal base and a threaded upper extremity of the fastening being secured in a central tapered part of the flat retaining part.

* * * * *